US008242983B2

(12) United States Patent
Yoo et al.

(10) Patent No.: US 8,242,983 B2
(45) Date of Patent: Aug. 14, 2012

(54) PIXEL AND ORGANIC LIGHT EMITTING DISPLAY DEVICE USING THE SAME

(75) Inventors: Myoung-Hwan Yoo, Yongin (KR); Keum-Nam Kim, Yongin (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 589 days.

(21) Appl. No.: 12/425,305

(22) Filed: Apr. 16, 2009

(65) Prior Publication Data

US 2009/0309856 A1 Dec. 17, 2009

(30) Foreign Application Priority Data

Jun. 11, 2008 (KR) ..... 10-2008-0054548

(51) Int. Cl.
*G09G 3/30* (2006.01)

(52) U.S. Cl. ..... 345/76; 315/169.3

(58) Field of Classification Search ..... 315/169.3; 345/76–81

See application file for complete search history.

(56) References Cited

U.S. PATENT DOCUMENTS

| | | | | |
|---|---|---|---|---|
| 7,649,515 | B2 * | 1/2010 | Ozawa et al. | 345/82 |
| 7,755,585 | B2 * | 7/2010 | Kim | 345/92 |
| 7,782,275 | B2 * | 8/2010 | Kim et al. | 345/76 |
| 8,049,684 | B2 * | 11/2011 | Kim | 345/76 |
| 8,149,186 | B2 * | 4/2012 | Kim | 345/76 |
| 2005/0093789 | A1 * | 5/2005 | Kim et al. | 345/76 |
| 2005/0243076 | A1 | 11/2005 | Kim et al. | |
| 2006/0077138 | A1 * | 4/2006 | Kim | 345/76 |
| 2007/0103406 | A1 * | 5/2007 | Kim | 345/76 |
| 2007/0115224 | A1 * | 5/2007 | Yamamoto et al. | 345/76 |

(Continued)

FOREIGN PATENT DOCUMENTS

EP 0 905 673 A1 3/1999

(Continued)

OTHER PUBLICATIONS

KIPO Office action dated Sep. 29, 2009, for priority Korean application 10-2008-0054548.

*Primary Examiner* — Amare Mengistu
*Assistant Examiner* — Dmitriy Bolotin
(74) *Attorney, Agent, or Firm* — Christie, Parker & Hale, LLP

(57) ABSTRACT

An pixel of an organic light emitting display device includes: an organic light emitting diode (OLED); a second transistor for supplying a current to the OLED; a first transistor coupled between a data line and a gate electrode of the second transistor, the first transistor being turned on when a scan signal is supplied to its gate electrode; a third transistor for supplying an initialization voltage to a drain electrode of the second transistor, the third transistor being turned on when a control signal is supplied to its gate electrode; a fourth transistor coupled between the drain electrode of the second transistor and a first power supply, the fourth transistor being turned-off when a light emitting control signal is supplied to its gate electrode and turned-on when the light emitting control signal is not supplied; and a storage capacitor coupled between the source and gate electrodes of the second transistor.

14 Claims, 4 Drawing Sheets

U.S. PATENT DOCUMENTS

| | | | | |
|---|---|---|---|---|
| 2007/0229411 | A1* | 10/2007 | Choi | 345/76 |
| 2008/0111774 | A1* | 5/2008 | Iida et al. | 345/76 |
| 2008/0197785 | A1* | 8/2008 | Uchino et al. | 315/169.3 |
| 2008/0203931 | A1* | 8/2008 | Kim | 315/169.3 |
| 2008/0224621 | A1* | 9/2008 | Uchino et al. | 315/169.3 |
| 2008/0231200 | A1* | 9/2008 | Yamamoto et al. | 315/169.3 |
| 2009/0009441 | A1* | 1/2009 | Yamamoto et al. | 345/80 |
| 2009/0027310 | A1* | 1/2009 | Kim | 345/76 |

FOREIGN PATENT DOCUMENTS

| | | |
|---|---|---|
| JP | 2007-140318 | 6/2007 |
| JP | 2008-26467 | 2/2008 |
| KR | 10-2002-0001566 | 1/2001 |
| KR | 10-2001-0098894 | 11/2001 |
| KR | 10-2001-0098936 | 11/2001 |
| KR | 10-2007-0112714 | 11/2007 |
| KR | 10-2007-0115261 | 12/2007 |

* cited by examiner

PIXEL AND ORGANIC LIGHT EMITTING DISPLAY DEVICE USING THE SAME

CROSS-REFERENCE TO RELATED APPLICATIONS

This application claims priority to and the benefit of Korean Patent Application No. 10-2008-0054548, filed on Jun. 11, 2008, in the Korean Intellectual Property Office, the entire content of which is incorporated herein by reference.

BACKGROUND

1. Field of the Invention

The present invention relates to a pixel and an organic light emitting display device using the same.

2. Discussion of Related Art

Recently, various flat panel display devices with reduced weight and volume in comparison to a cathode ray tube display device have been developed. The flat panel display devices include a liquid crystal display (LCD) device, a field emission display (FED) device, a plasma display panel (PDP), an organic light emitting display device, etc.

An organic light emitting display device displays an image by using organic light emitting diodes (OLEDs) to generate light by the recombination of electrons and holes. The organic light emitting display device has a fast response speed and a low power consumption.

The organic light emitting display device controls the amount of current flowing to the organic light emitting diode by using driving transistors, which are included in each pixel to express a gray level. Typical organic light emitting display devices suffer from a problem of displaying an image with non-uniform luminance due to variations in threshold voltage and mobility of the driving transistors.

In order to overcome the foregoing problem, a method capable of compensating for the threshold voltage and the mobility of the driving transistor by changing an electric potential of a power supply, which supplies a current to the organic light emitting diode, into a first electric potential (high electric potential) or a second electric potential (low electric potential) has been suggested. (Korea Patent Publication 10-2007-0112714)

However, in order to change the electric potential of the power supply, extra circuit components are required (e.g., a filter etc.), and the power supply may require a heat sink due to the generation of high heat.

SUMMARY OF THE INVENTION

Accordingly, embodiments of the present invention provide a pixel and an organic light emitting display device using the same capable of compensating for threshold voltage and mobility of a driving transistor without changing the electric potential of a power supply.

An organic light emitting display device according to an embodiment of the present invention includes: a scan driver for driving scan lines, light emitting control lines and control lines; a data driver for supplying a reference voltage from a reference power supply and a data signal to the data lines; and pixels at crossing regions of the scan lines and the data lines, each of the pixels including: an organic light emitting diode having a cathode electrode coupled to a second power supply; a second transistor for supplying a current to the organic light emitting diode; a first transistor coupled between a data line of the data lines and a gate electrode of the second transistor, the first transistor configured to turn on when a scan signal is supplied to a corresponding scan line of the scan lines; a third transistor coupled between an initialization power supply for supplying an initialization voltage and a drain electrode of the second transistor, the third transistor configured to turn on when a control signal is supplied to the a corresponding control line of the control lines; a fourth transistor coupled between the drain electrode of the second transistor and a first power supply, the fourth transistor configured to turn off when a light emitting control signal is supplied to a corresponding one of the light emitting control lines and turn on when the light emitting control signal is not supplied to the light emitting control line; and a storage capacitor coupled between the source electrode and the gate electrode of the second transistor.

The scan signal may be supplied to the scan line in a first period, a second period, and a third period, and the scan driver may be configured to supply the control signal to the control line and the light emitting control signal to the light emitting control line during the first period. The data driver may be configured to supply the reference voltage to the data lines during the first period and the second period, and supply the data signal during the third period. The reference voltage may be higher than the initialization voltage. The initialization voltage may have a voltage value that turns on the second transistor when the reference voltage is supplied to the gate electrode of the second transistor, and allows the voltage between the gate and the source of the second transistor to be higher than a threshold voltage of the second transistor. A voltage of the second power supply may be configured to turn off the organic light emitting diode when the initialization voltage is applied to an anode electrode of the organic light emitting diode. A voltage of the first power supply may be higher than the reference voltage.

A pixel according to an embodiment of the present invention includes: an organic light emitting diode; a second transistor for supplying a current to the organic light emitting diode; a first transistor coupled between a data line and a gate electrode of the second transistor, the first transistor having a gate electrode coupled with a scan line; a third transistor coupled between an initialization power supply and a drain electrode of the second transistor, the third transistor having a gate electrode coupled with a control line; a fourth transistor coupled between the drain electrode of the second transistor and the first power supply, the fourth transistor having a gate electrode coupled with a light emitting control line; and a storage capacitor coupled between the source electrode and the gate electrode of the second transistor.

Each of the first, second, third and fourth transistors may be an N-type transistor.

A pixel of an organic light emitting display device according to an embodiment of the present invention includes: an organic light emitting diode; a driving transistor for supplying a current to the organic light emitting diode, a source electrode of the driving transistor coupled to an anode of the organic light emitting diode; a capacitor coupled between a gate electrode of the driving transistor and the source electrode of the driving transistor; a control transistor coupled to a drain electrode of the driving transistor for supplying an initialization voltage to the drain electrode of the driving transistor; and a data transistor coupled to the gate electrode of the driving transistor for supplying a reference voltage to the gate electrode of the driving transistor. The control transistor and the data transistor are configured to store a voltage at the capacitor to compensate for a threshold voltage of the driving transistor and a voltage corresponding to a mobility of the driving transistor while a scan signal is applied to the data transistor.

Furthermore, the pixel may include a light emitting control transistor coupled between the drain electrode of the driving transistor and a power supply for supplying the current, and the light emitting control transistor has a gate electrode coupled with a light emitting control line.

An organic light emitting display device according to the embodiments of the present invention is capable of compensating for the threshold voltage and the mobility of the driving transistor while constantly maintaining the electric potential of the first power supply.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
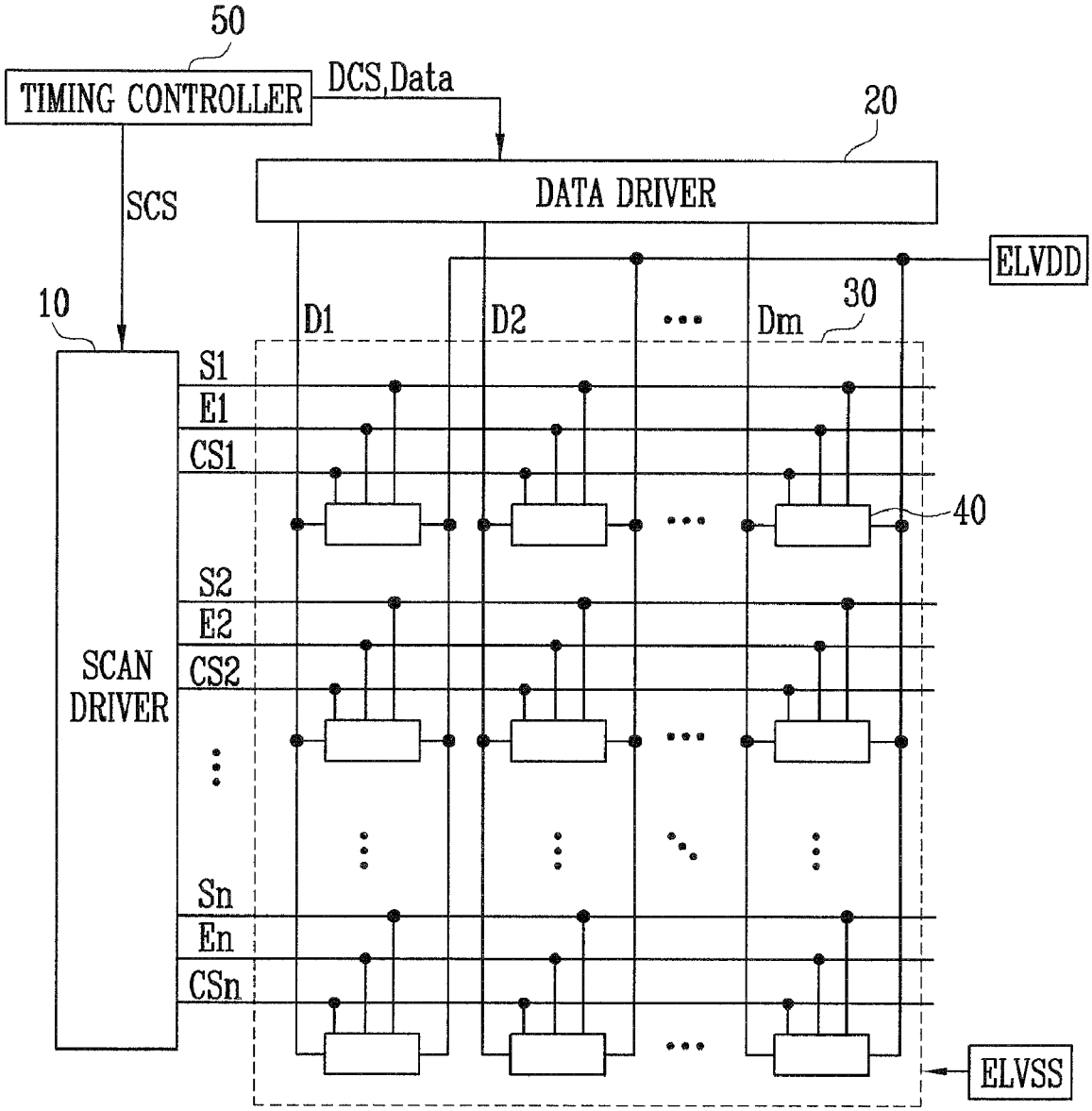
FIG. 1 is a schematic circuit diagram showing an organic light emitting display device according to an embodiment of the present invention.

Hereinafter, certain exemplary embodiments according to the present invention will be described with reference to the accompanying drawings. Here, when a first element is described as being coupled to a second element, the first element may be directly coupled to the second element, or may be indirectly coupled to the second element via a third element. Further, some of elements that are not essential to a complete understanding of the invention are omitted for clarity. Also, like reference numerals refer to like elements throughout.

Hereinafter, an exemplary embodiment of the present invention will be described in a more detailed manner with reference to the accompanying drawings of FIG. 1 to FIG. 4D.

FIG. 1 shows an organic light emitting display device according to an embodiment of the present invention.

Referring to FIG. 1, the organic light emitting display device according to the embodiment of the present invention includes a display unit 30 having a plurality of pixels 40 coupled with scan lines S1 to Sn, light emitting control lines E1 to En, control lines CS1 to CSn, and data lines D1 to Dm; a scan driver 10 for driving the scan lines S1 to Sn, the light emitting control lines E1 to En, and the control lines CS1 to CSn; a data driver 20 for driving the data lines D1 to Dm; and a timing controller 50 for controlling the scan driver 10 and the data driver 20.

The timing controller 50 generates a data drive control signal DCS and a scan drive control signal SCS corresponding to externally supplied synchronization signals. The data drive control signal DCS generated in the timing controller 50 is supplied to the data driver 20, and the scan drive control signal SCS is supplied to the scan driver 10. The timing controller 50 supplies the externally supplied data to the data driver 20.

The scan driver 10 sequentially supplies a scan signal (e.g., a high level signal) to the scan lines S1 to Sn to sequentially select the pixels 40 per line unit (i.e., line by line). Also, the scan driver 10 sequentially supplies a light emitting control signal (e.g., a low level signal) to the light emitting control lines E1 to En, and sequentially supplies a control signal (e.g., a high level signal) to the control lines CS1 to CSn.

Figure 3:
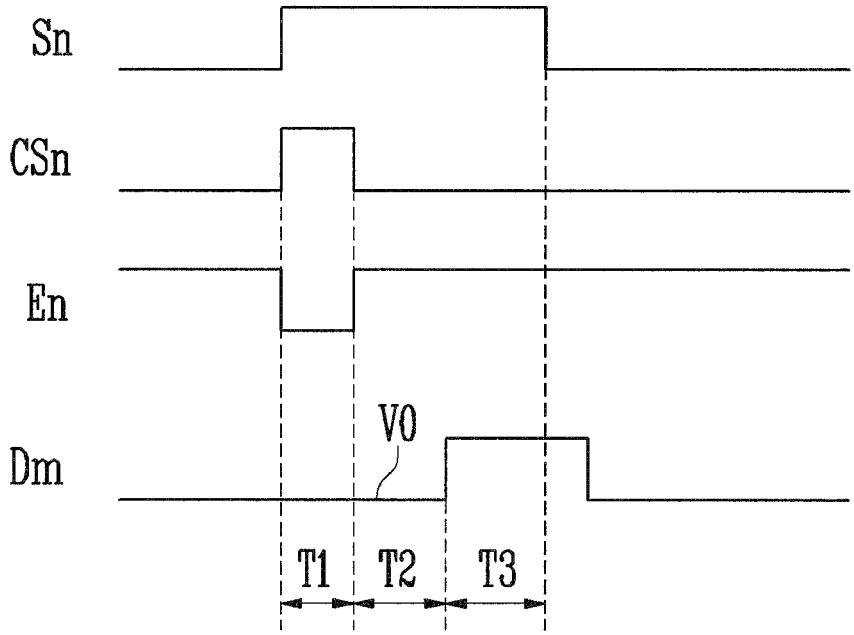
FIG. 3 is a schematic timing diagram showing waveforms of a driving method for driving the pixel shown in FIG. 2.

The scan driver 10 supplies the light emitting control signal to an $n^{th}$ light emitting control line En and supplies the control signal to an $n^{th}$ control line CSn, during a first period T1 of periods in which the scan signal is supplied to an $n^{th}$ (n is natural number) scan line Sn as shown in FIG. 3.

Meanwhile, the periods in which the scan signal is supplied include the first period T1, a second period T2, and a third period T3. The first period T1 is a period for initializing a driving transistor, and the second period T2 is a period for compensating for the threshold voltage of the driving transistor. The third period T3 is a period for charging a voltage corresponding to the data signal.

The data driver 20 supplies a voltage VO of a reference power supply during the first period T1 and the second period T2 of periods in which the scan signal is supplied, and supplies the data signal during the third period T3. Herein, the voltage (or electric potential) VO of the reference power supply is set to be higher than the voltage (or electric potential) Vinit of the initialization power supply. For example, the voltage (or electric potential) VO of the reference power supply can be set to a ground potential (e.g., 0V).

The display unit 30 is supplied with a voltage ELVDD from a first power supply and a voltage ELVSS from a second power supply. The first power supply and/or the second power supply may be external to the display unit 30. Each pixel 40 supplied with the first power supply at the voltage ELVDD and the second power supply at the voltage ELVSS is supplied with the data signal when the scan signal is supplied, and a current corresponding to the data signal is supplied to an organic light emitting diode included in each pixel 40.

Figure 2:
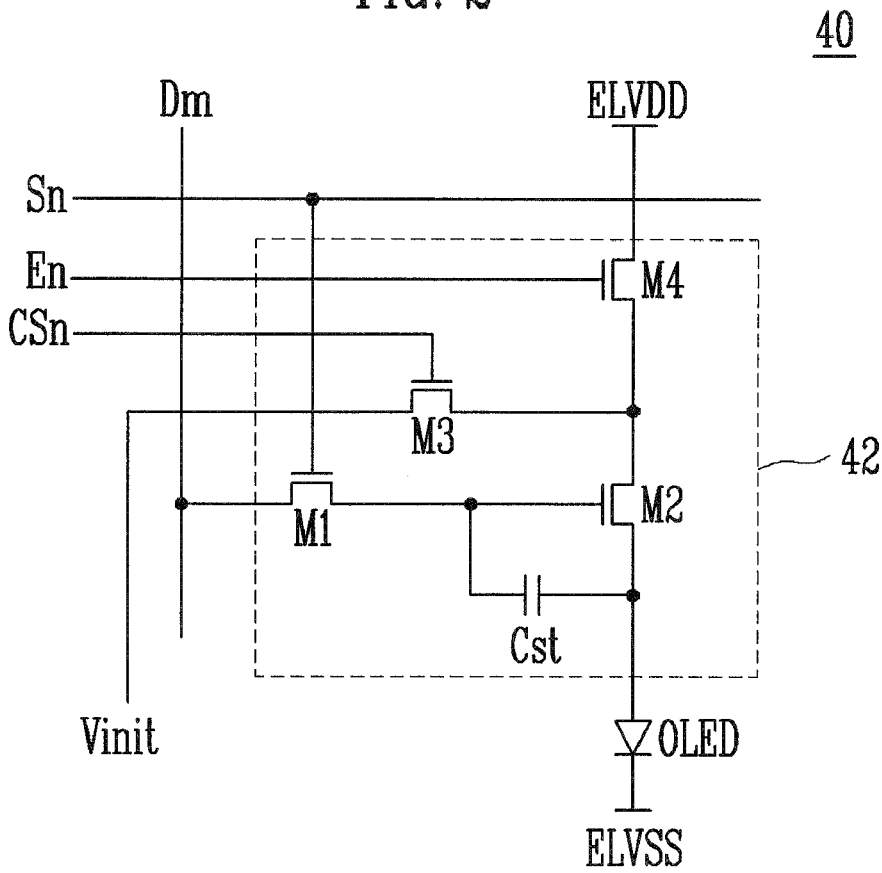
FIG. 2 is a schematic circuit diagram showing an embodiment of a pixel shown in FIG. 1.

FIG. 2 shows an embodiment of the pixel 40 shown in FIG. 1. The pixel 40 shown in FIG. 2 includes N-type transistor only (for example, NMOS).

Referring to FIG. 2, the pixel 40 according to the embodiment of the present invention is coupled with an organic light emitting diode (OLED), a data line Dm, and a scan line Sn, and the pixel 40 includes a pixel circuit 42 for controlling the OLED.

An anode electrode of the OLED is coupled to the pixel circuit 42, and a cathode electrode is coupled to the second power supply. The OLED generates light with a luminance corresponding to a current supplied from the pixel circuit 42.

The pixel circuit 42 controls the amount of current supplied to the OLED corresponding to the data signal. The pixel circuit 42 includes first to fourth transistors M1 to M4 and a storage capacitor Cst.

The gate electrode of the first transistor M1 is coupled with the scan line Sn, and the second electrode thereof is coupled to the data line Dm. And, the first electrode of the first transistor M1 is coupled to a first terminal of the storage capacitor Cst. The first transistor M1 is turned-on when the scan signal is supplied to the scan line Sn to supply the data signal and the voltage VO of the reference power supplied from the data line Dm to the storage capacitor Cst.

The gate electrode of the second transistor M2 (e.g., a drive transistor) is coupled to the first terminal of the storage capacitor Cst, and the second electrode of the second transistor M2 is coupled to the first electrode of the fourth transistor M4. And, the first electrode of the second transistor M2 is coupled to the anode electrode of the OLED. The second transistor M2 controls the amount of current flowing from the first power supply at the voltage ELVDD to the second power supply at the voltage ELVSS via the OLED corresponding to a voltage stored in the storage capacitor Cst. The OLED generates the light corresponding to the amount of current supplied from the second transistor M2.

The storage capacitor Cst is coupled between the first electrode and the gate electrode of the second transistor M2. The storage capacitor Cst is charged with a voltage corresponding to the data signal and the threshold voltage of the second transistor M2.

The first electrode of the third transistor M3 is coupled to the second electrode of the second transistor M2, and the second electrode of the third transistor M3 is coupled to the initialization power supply that supplies the voltage Vinit. Further, the gate electrode of the third transistor M3 is coupled to the control line CSn. The third transistor M3 is turned-on when the control signal is supplied to the control line CSn to transmit the voltage Vinit from the initialization power supply to the second electrode of the second transistor M2.

The second electrode of the fourth transistor M4 is coupled to the first power supply, and the first electrode thereof is coupled to the second electrode of the second transistor M2. In addition, the gate electrode of the fourth transistor M4 is coupled to the light emitting control line En.

FIG. 3 shows waveforms of a method of driving the pixel 40 shown in FIG. 2, and FIGS. 4A to 4D are schematic circuit diagrams showing a driving operation corresponding to the waveforms shown in FIG. 3.

Figure 4A:
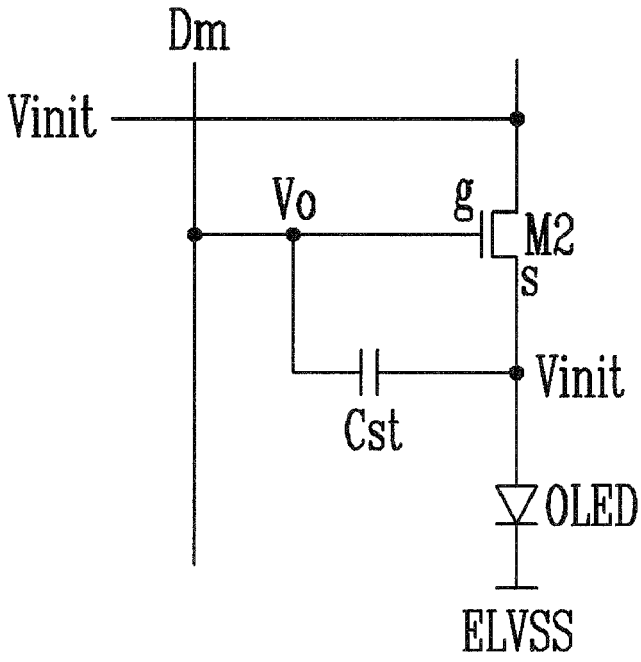
FIGS. 4A to 4D are schematic circuit diagrams showing a driving process of the pixel shown in FIG. 2.
Figure 4B:
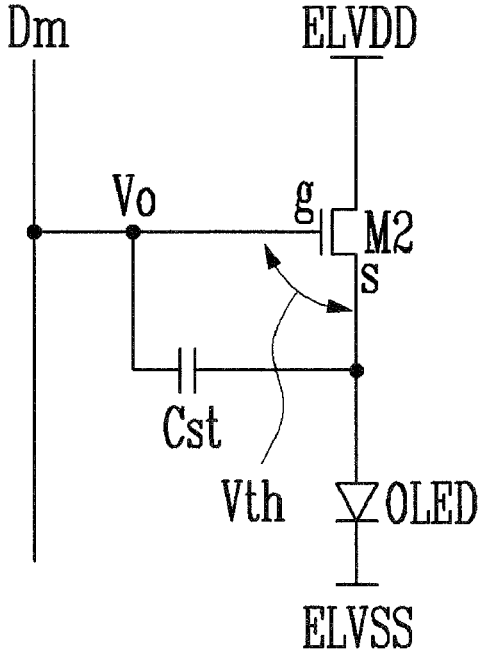
Figure 4C:
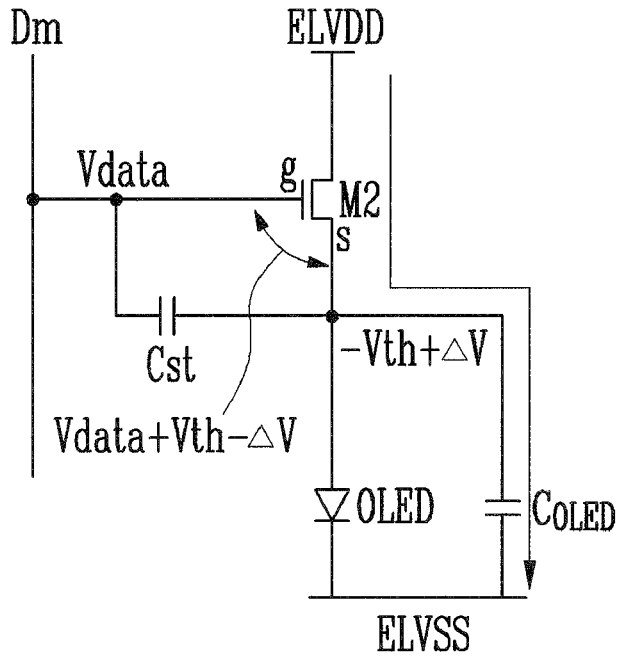
Figure 4D:
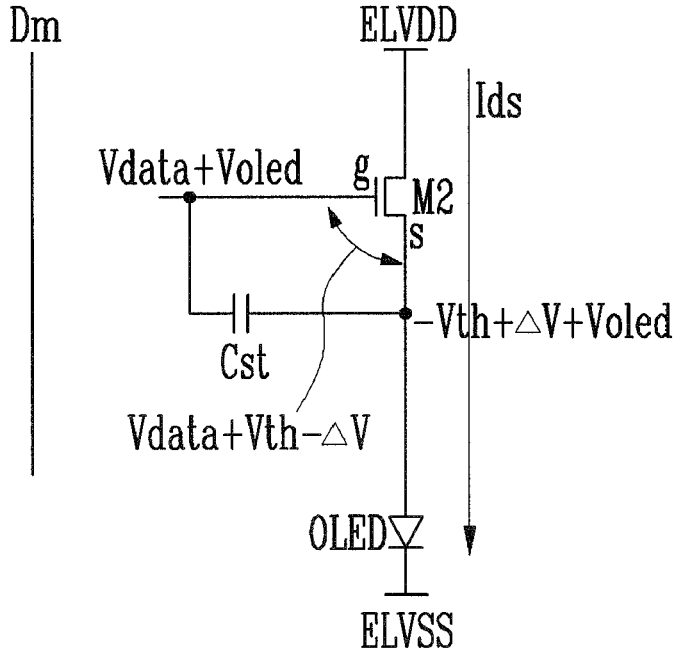

During the operation process of the pixel 40 as described in detail in conjunction with FIG. 2 and FIG. 4D, the scan signal is supplied to the scan line Sn so that the first transistor M1 is turned-on. The light emitting control signal is supplied to the light emitting control line En during the first period T1 of the periods in which the scan signal and the control signal are respectively supplied to the scan line Sn and the control line CSn. When the light emitting control signal (e.g., a low level signal) is supplied to the light emitting control line En, the fourth transistor M4 is turned off. When the control signal (e.g., a high level signal) is supplied to the control line CSn, the third transistor M3 is turned-on.

When the third transistor M3 is turned-on, the voltage Vinit from the initialization power supply is supplied to the second electrode of the second transistor M2 as shown in FIG. 4A. When the first transistor M1 is turned on, the voltage VO of the reference power supply is supplied from the data line Dm to the gate electrode of the second transistor M2. At this time, the second transistor M2 is turned on so that an electric potential of the first electrode of the second transistor M2 is set to the voltage (or electric potential) Vinit of the initialization power supply. Here, the voltage (or electric potential) Vinit of the initialization power supply is set to be sufficiently lower than the voltage (or electric potential) VO of the reference power supply. For example, the voltage (or electric potential) Vinit of the initialization power supply is suitably low to turn on the second transistor M2 and is set to allow the voltage Vgs between the gate and the source of the second transistor M2 to be higher than the threshold voltage Vth of the second transistor M2.

The control signal and the light emitting control signal are suspended (or not applied) during the second period T2 in which the scan signal is supplied. When the supply of the control signal is suspended, the third transistor M3 is turned off. When the supply of the light emitting control signal is suspended, the fourth transistor M4 is turned on.

When the fourth transistor M4 is turned on, the voltage of the first electrode of the second transistor M2 gradually rises. When the voltage Vgs between the gate and the source of the second transistor M2 is substantially equal to the threshold voltage of the second transistor M2 as shown in FIG. 4B, the second transistor M2 is turned off. In other words, since the voltage (or electric potential) ELVDD of the first power supply is set to be higher than the electric potential of the reference power supply VO, the second transistor M2 is turned off at a moment when the voltage Vgs of the second transistor M2 is substantially equal to the threshold voltage Vth.

The voltage (or electric potential) ELVSS of the second power supply is suitably set so as to prevent a current from flowing to the OLED during the first period T1 and the second period T2. In other words, the OLED is maintained in the turned-off state when a voltage Vinit of the initialization power supply is applied to the OLED. Accordingly, a voltage equal to the threshold voltage of the second transistor M2 can be stably charged in the storage capacitor Cst during the second period T2.

The data signal is supplied to the data line Dm during the third period T3 of the periods in which the scan signal is supplied. When the data signal having a voltage Vdata is supplied to the data line Dm, the voltage at the gate electrode of the second transistor M2 rises to the voltage Vdata as shown in FIG. 4C.

Initially, the OLED is maintained at a turned-off state when a drive current Ids supplied from the second transistor M2 is charging a parasitic capacitance $C_{OLED}$ of the OLED. The voltage of the first electrode of the second transistor M2 gradually rises, and thus the voltage Vgs of the second transistor M2 becomes Vdata+Vth−ΔV, where ΔV is the voltage determined by the data signal Vdata and the mobility. When the data signal Vdata is constantly maintained, the larger the mobility, the larger the absolute value of the ΔV becomes. The value of the −ΔV stored in the storage capacitor Cst compensates for the mobility of each of the pixels 40, making it possible to display an image with uniform luminance.

The supply of the scan signal is suspended after a voltage equal to Vdata+Vth−ΔV is charged in the storage capacitor Cst, so that the first transistor M1 is turned off. For example, a stop point (or a suspension timing) of the scan signal supplied to the scan line Sn is experimentally determined so as to store the voltage equal to Vdata+Vth−ΔV in the storage capacitor Cst.

When the first transistor M1 is turned off, the gate electrode of the second transistor M2 is in a floating state as shown in FIG. 4D. Therefore, the storage capacitor Cst stably maintains its charged voltage during the previous period by the drive current Ids supplied from the second transistor M2 regardless of the voltage Voled across to the OLED.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device comprising:

a scan driver for driving scan lines, light emitting control lines and control lines;

a data driver for supplying a reference voltage from a reference power supply and a data signal to data lines; and pixels at crossing regions of the scan lines and the data lines, each of the pixels comprising:

an organic light emitting diode having a cathode electrode coupled with a second power supply;

a second transistor for supplying a current to the organic light emitting diode;

a first transistor coupled between a data line of the data lines and a gate electrode of the second transistor, the first transistor configured to turn on when a scan signal is supplied to a corresponding scan line of the scan lines;

a third transistor coupled between an initialization power supply for supplying an initialization voltage and a drain electrode of the second transistor, the third transistor configured to turn on when a control signal is supplied to a corresponding control line of the control lines to supply the initialization voltage to the drain electrode of the second transistor;

a fourth transistor coupled between the drain electrode of the second transistor and a first power supply, the fourth transistor configured to turn off when a light emitting control signal is supplied to a corresponding one of the light emitting control lines and turn on when the light emitting control signal is not supplied to the light emitting control line; and a storage capacitor coupled between a source electrode and the gate electrode of the second transistor.

2. An organic light emitting display device comprising:

a scan driver for driving scan lines, light emitting control lines and control lines;

a data driver for supplying a reference voltage from a reference power supply and a data signal to data lines; and pixels at crossing regions of the scan lines and the data lines, each of the pixels comprising:

an organic light emitting diode having a cathode electrode coupled with a second power supply;

a second transistor for supplying a current to the organic light emitting diode;

a first transistor coupled between a data line of the data lines and a gate electrode of the second transistor, the first transistor configured to turn on when a scan signal is supplied to a corresponding scan line of the scan lines;

a third transistor coupled between an initialization power supply for supplying an initialization voltage and a drain electrode of the second transistor, the third transistor configured to turn on when a control signal is supplied to a corresponding control line of the control lines;

a fourth transistor coupled between the drain electrode of the second transistor and a first power supply, the fourth transistor configured to turn off when a light emitting control signal is supplied to a corresponding one of the light emitting control lines and turn on when the light emitting control signal is not supplied to the light emitting control line; and a storage capacitor coupled between a source electrode and the gate electrode of the second transistor, wherein the scan signal is supplied to the scan line in a first period, a second period and a third period, and the scan driver is configured to supply the control signal to the control line and the light emitting control signal to the light emitting control line during the first period.

3. The organic light emitting display device according to claim 2, wherein the data driver is configured to supply the reference voltage to the data lines during the first period and the second period, and to supply the data signal during the third period.

4. The organic light emitting display device according to claim 1, wherein the reference voltage is higher than the initialization voltage.

5. The organic light emitting display device according to claim 1, wherein the initialization voltage has a voltage value that turns on the second transistor when the reference voltage is supplied to the gate electrode of the second transistor, and allows the voltage between the gate electrode and the source electrode of the second transistor to be higher than a threshold voltage of the second transistor.

6. The organic light emitting display device according to claim 1, wherein the second power supply is configured to supply a voltage to turn off the organic light emitting diode when the initialization voltage is applied to an anode electrode of the organic light emitting diode.

7. The organic light emitting display device according to claim 1, wherein a voltage of the first power supply is higher than the reference voltage.

8. A pixel of an organic light emitting display, the pixel comprising:

an organic light emitting diode;

a second transistor for supplying a current to the organic light emitting diode;

a first transistor coupled between a data line and a gate electrode of the second transistor, the first transistor having a gate electrode coupled with a scan line;

a third transistor coupled between an initialization power supply and a drain electrode of the second transistor, the third transistor having a gate electrode coupled with a control line and being configured to supply a voltage of the initialization power supply to the drain electrode of the second transistor;

a fourth transistor coupled between the drain electrode of the second transistor and a first power supply, the fourth transistor having a gate electrode coupled with a light emitting control line; and a storage capacitor coupled between a source electrode and the gate electrode of the second transistor.

9. The pixel according to claim 8, wherein each of the first, second, third and fourth transistors is an N-type transistor.

10. A pixel of an organic light emitting display device, the pixel comprising:

an organic light emitting diode;

a driving transistor for supplying a current to the organic light emitting diode, a source electrode of the driving transistor coupled to an anode electrode of the organic light emitting diode;

a capacitor coupled between a gate electrode of the driving transistor and the source electrode of the driving transistor;

a control transistor coupled between an initialization power supply for supplying an initialization voltage and a drain electrode of the driving transistor, the control transistor being configured to turn on when a control signal is supplied to a gate electrode of the control transistor to supply the initialization voltage to the drain electrode of the driving transistor; and a data transistor coupled to the gate electrode of the driving transistor for supplying a reference voltage to the gate electrode of the driving transistor, wherein the control transistor and the data transistor are configured to store a voltage at the capacitor to compensate for a threshold voltage of the driving transistor and a voltage corresponding to a mobility of the driving transistor while a scan signal is applied to the data transistor.

11. The pixel of claim 10, further comprising:

a light emitting control transistor coupled between the drain electrode of the driving transistor and a power supply for supplying the current, the light emitting control transistor having a gate electrode coupled with a light emitting control line.

12. The pixel of claim 10, wherein the reference voltage is higher than the initialization voltage.

13. The pixel of claim 10, wherein the initialization voltage has a voltage value that turns on the driving transistor when the reference voltage is supplied to the gate electrode of the driving transistor, and allows the voltage between the gate and the source of the driving transistor to be higher than a threshold voltage of the driving transistor.

14. The pixel of claim 10, wherein the organic light emitting diode is configured to turn off when the initialization voltage is applied to the anode electrode of the organic light emitting diode.

* * * * *